US006036029A

United States Patent [19]

Gommel et al.

[11] Patent Number: 6,036,029

[45] Date of Patent: Mar. 14, 2000

[54] DEVICE TO DRAIN A FIBROUS PULP SUSPENSION

[75] Inventors: Axel Gommel, Ravensburg; Josef Schneid, Vogt, both of Germany

[73] Assignee: Voith Sulzer Stoffaufbereitung GmbH, Ravensburg, Germany

[21] Appl. No.: 08/921,109

[22] Filed: Aug. 29, 1997

[30] Foreign Application Priority Data

Aug. 30, 1996 [DE] Germany ..... 196 35 293
Aug. 30, 1996 [DE] Germany ..... 196 35 217

[51] Int. Cl.[7] ..... B01D 33/00

[52] U.S. Cl. ..... 210/391; 210/400; 210/402; 210/407; 162/358.1; 162/56; 100/116; 100/121; 100/151; 100/152

[58] Field of Search ..... 210/784, 400, 210/402, 403, 391, 407; 100/37, 116, 121, 151, 152, 153; 162/56, 100, 189, 358.1, 358.4, 368, 373

[56] References Cited

U.S. PATENT DOCUMENTS 50,158 9/1865 Pool et al. .
838,615 12/1906 Goldman .
1,595,894 8/1926 Klund .
2,365,658 12/1944 Schumacher .

FOREIGN PATENT DOCUMENTS 0251787 1/1988 European Pat. Off. .
0369611 5/1990 European Pat. Off. .
4105803 2/1997 Germany .
9608600 3/1996 WIPO .

OTHER PUBLICATIONS

Copy of a German Office Action dated Apr. 17, 1995 with German Application No. 196 35 217.7–45.

Copy of a German Action dated Apr. 18, 1997 with Application No. DE 196 35 293.2–45.

*Primary Examiner*—Robert J. Popovics
*Attorney, Agent, or Firm*—Greenblum & Bernstein, P.L.C.

[57] ABSTRACT

A device to drain a fibrous pulp suspension including an arched surface that is impermeable. The arched surface, moreover, is surrounded by a permeable belt. The belt and the arched surface are able to be moved such that there exists a relative velocity between the belt and the arched surface. The arched surface includes recesses that are able to take up quantities of fluid.

38 Claims, 11 Drawing Sheets

DEVICE TO DRAIN A FIBROUS PULP SUSPENSION

CROSS-REFERENCE TO RELATED APPLICATION

The present application claims priority under 35 U.S.C. § 119 of German Patent Application No. 196 35 293.2 filed Aug. 30, 1996 and German Patent Application No. 196 35 217.7, filed Aug. 30, 1996, the disclosures of which are expressly incorporated by reference herein in their entirety.

BACKGROUND OF THE INVENTION

1. Field of the Invention

The present invention relates to a device to drain a fibrous pulp suspension.

2. Background of the Invention

A device for draining a fibrous pulp suspension is know which includes an arched surface as, for example, a roll. Moreover, it is known to have a portion of the circumference of the arched surface encircled by a screen belt. The screen belt and sleeve surface of the roll create an inlet slit for draining the fibrous pulp suspension.

Such a device is described in WO 96/08600. In this reference, the arched surface is a roll with openings that open into the roll interior. The roll is, moreover, placed under suction. A portion of the circumference of the roll surface is surrounded by a substantially impermeable belt.

This device is disadvantageous because the fibers adhere to the impermeable belt during operation. The fibers very quickly create fiber clumps and seriously interfere with the operation of the device. Further, to clean the device, it is necessary to stop the machine and disassemble the belt.

SUMMARY OF THE INVENTION

The present invention overcomes the above-noted defects and disadvantages of the prior art by improving the device to drain a fibrous pulp suspension.

The object of the present invention is to create a device for draining a fibrous pulp suspension which achieves a high draining capacity but which presents no or only minor cleaning problems.

According to one embodiment of the present invention, the device to drain a fibrous pulp suspension includes an arched surface, which is impermeable and which includes a plurality of recesses that are able to receive and transport a quantity of a fluid. The fluid received by the plurality of recesses is a fibrous pulp suspension.

The device further includes a permeable belt encircling the arched surface. Further, the permeable belt and the arched surface independently move, resulting in relative velocity between the permeable belt and the arched surface.

According to another aspect of the invention, the device may include a plurality of rails which create a plurality of recesses on the arched surface. Further, the device may include a cleaning device positioned near the arched surface and near the permeable belt for removing contaminants. The arched surface may be substantially smooth. Further, the arched surface may comprise a roll.

In accordance with another aspect of the invention, the permeable belt may have two ends, as opposed to being continuous. The permeable belt unwinds at a creeping speed from an unwinding roll and winds onto an uptake roll. The unwinding and winding are reversible and the roll is capable of being driven at a high speed relative to the speed of the permeable belt.

The permeable belt and the roll are driven at different speeds. The differential speed or velocity of the belt and roll may be as low as, e.g., approximately a few millimeters per second. However, the actual velocity of the belt and roll may be as low as, e.g., approximately a few millimeter or a few centimeters per second, or as high as, e.g., between approximately ten and fifty meters per second.

According to one embodiment of the invention, the permeable belt essentially comprises an elastic wire mesh. According to another aspect of the invention, the permeable belt may comprise a stiff, flexible material, such as, for example, an arched perforated metal sheet placed over the arched surface.

The plurality of recesses, which receive and transport the fluid, may be formed by a plurality of spherical dents. Further, the spherical dents may be spaced evenly across the arched surface. The plurality of recesses may be formed by a plurality of spherical humps, which may also be spaced evenly across the arched surface. The recesses may also comprise a plurality of grooves that extend substantially across the direction of the relative movement of the belt and the arched surface. The grooves, moreover, may be divided into longitudinal sections.

According to another embodiment of the invention, the device may include a plurality of rails which create the plurality of recesses.

Further, the device may include a plurality of bores that extend substantially perpendicular to the direction of motion from one face side of the arched surface to the other face side of the arched surface. The arched surface here is made of an elastic moldable material. The plurality of bores, moreover, may be inflatable and deflatable.

The device may include a support construction and a hose which is made of an elastic material and which encircles the support construction. The device may further include a plurality of support units or rails that are positioned between the hose and the support construction. The support units or rails form a plurality of gaps between adjacent support units. Each of the adjacent support units can be inflated or deflated.

According to another aspect of the invention, the arched surface may exhibit a plurality of different radii along the length of the arched surface. The different radii are measured to a center point of the arched surface. Further, the different radii may decrease in the direction of the belt rotation thereby increasing the draining pressure with a constant screen tension.

The device further may include a covering screen to cover the recesses of the arched surface. The covering screen may surround the arched surface.

Another way to describe the present invention is a device to drain a fibrous pulp suspension comprising an arched surface wherein the arched surface is impermeable and includes a plurality of recesses that are capable of receiving a quantity of fluid. The arched surface further includes a grid structure for creating the plurality of recesses. The device further includes a permeable belt that is moved relative to the arched surface resulting in a relative velocity between the permeable belt and the arched surface.

According to another aspect of the invention, the plurality of recesses are able to receive a quantity of the fibrous pulp suspension. Further, the grid structure may be in the shape of a honeycomb.

The arched surface may be a circumference area or a sleeve of a roll. The device, moreover, may include a screen to cover the plurality of recesses. The screen may surround the arched surface.

According to another aspect of the present invention, the arched surface and the permeable belt form an inlet slit to receive the fluid, which can comprise a fibrous pulp suspension. Further, the arched surface may comprise a roll.

According to another embodiment of the invention, the roll may include a support construction which comprises either a hollow cylindrical core or a solid cylindrical core. In addition to the cylindrical core, the support construction may also include a plurality of rails that form a plurality of gaps. The rails extend radially from the surface of the cylindrical core. Further, the roll includes a flexible hose that is water impermeable and that is capable of shrinking onto the plurality of rails, forming a wave profile over which the permeable belt travels.

According to the present invention, because the belt is essentially permeable and is continuously rinsed during operation, the device presents almost no cleaning problems with respect to the cleanliness of the belt surrounding the roll, because the belt is essentially permeable and is continuously rinsed during operation. In addition, the belt can, if required, be cleaned outside the working zone through suitable conventional means. Another advantage of the present invention is exemplified by the very high dry contents that may be achieved with the device, depending on established operating parameters such as the type of pulp of the fibrous pulp suspension, the screen tension, the circulating velocity of the roll, and so on. The pulp, which is substantially dry, is extracted from the fibrous pulp suspension, is present in the form of a sheet. In some cases, the pulp is in the form of small fibrous pulp rolls, whose axes extend parallel to the roll axes during their creation, and which can have a diameter of less than one millimeter to several millimeters.

The present invention also applies the known principle that a relative velocity exists between the sleeve surface of the roll and the screen. The screen or the roll can remain completely stationary during the operation, i.e. perform no translational motion. They can, however, move at variable speeds, including creeping speed.

BRIEF DESCRIPTION OF THE DRAWINGS

The invention will be better understood by referring to the following description with reference to the drawings. The drawings illustrate, by way of non-limiting examples, embodiments of the invention, with like reference numbers representing similar parts throughout the several views, and wherein.

DETAILED DESCRIPTION OF THE DRAWINGS

Figure 1:
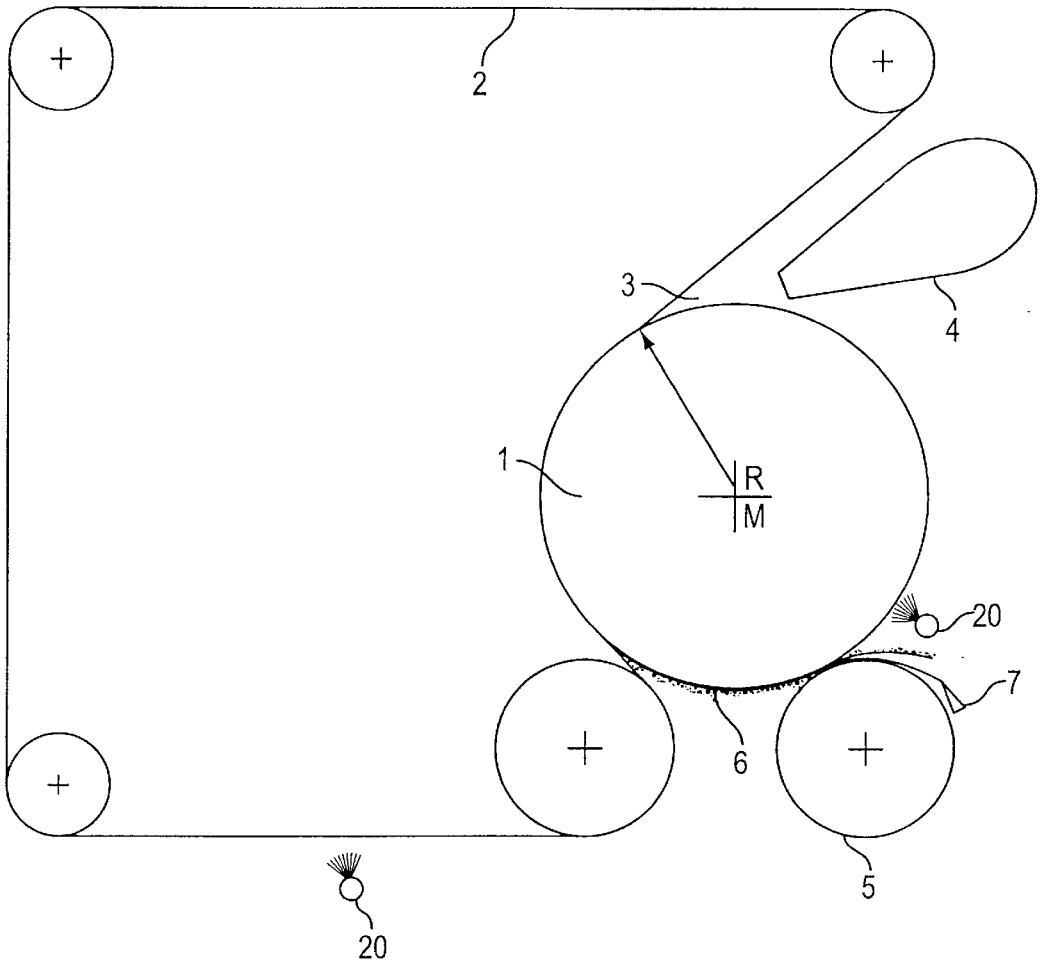
FIG. 1 is a schematic diagram of one embodiment of a device for draining a fibrous pulp suspension.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

As shown in FIG. 1, the device, in accordance with the invention, includes an arched surface and a screen belt 2 which encircles the arched surface on part of the circumference of the arched surface. In the present embodiment, the arched surface is the top surface of a roll 1. The roll 1 exhibits a uniform curvature of radius R across the entire circumferential area of the roll 1. However, it is possible to have an arched surface that includes a changing radius.

Figure 1A:
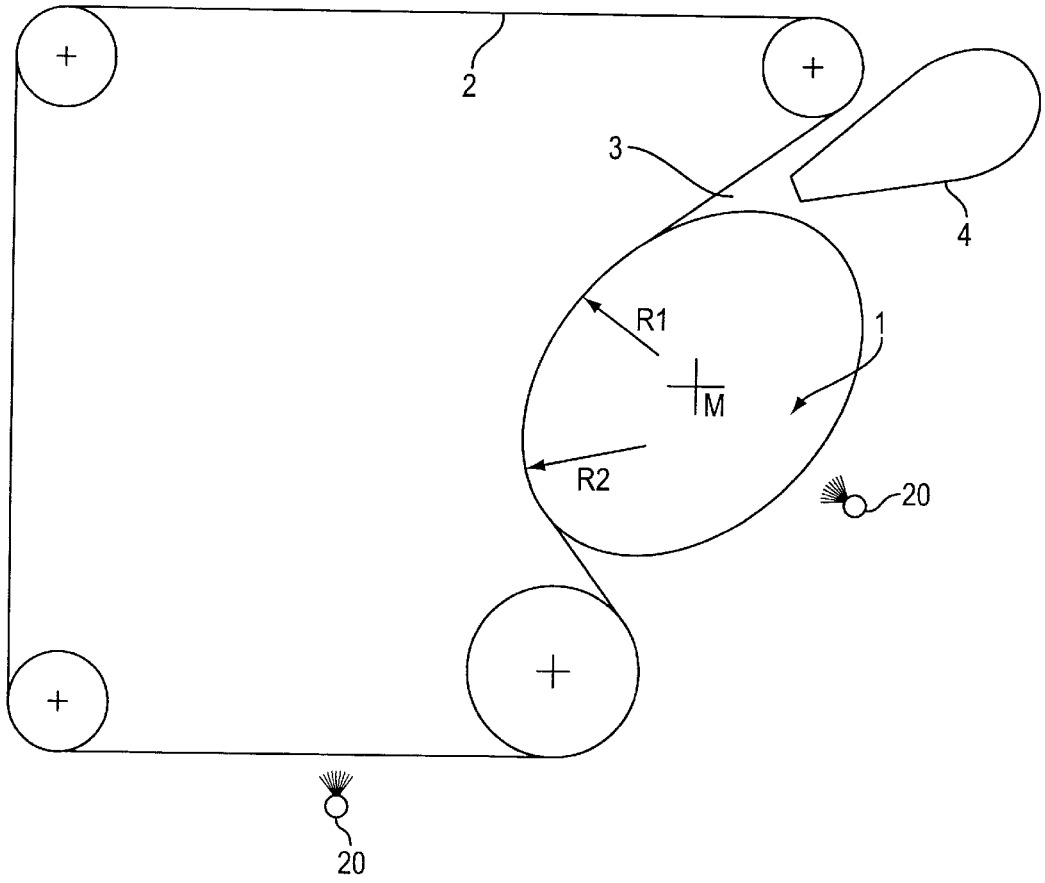
FIG. 1A is a schematic diagram of one aspect of one embodiment of a device for draining a fibrous pulp suspension.

For example, as shown in FIG. 1A, the radius may decrease in the direction away from the wedge-shaped inlet slit 3, which is formed by the arched surface or by the sleeve of the roll 1 and the screen belt 2. The fibrous pulp suspension is introduced into the inlet slit 3. In FIG. 1A, the screen belt 2 winds on the roll 1 where the roll 1 has the smaller curvature, with radius $R_1$, and unwinds from the roll 1 where the roll 1 has the larger curvature, with radius $R_2$.

Devices of the type described in FIG. 1 can be easily cleaned by rotating the body surrounded by the arched surfaces by 180° around the center M. The dirty side, thus, is easily accessible for cleaning while ensuring only a brief interruption of operation.

According to one aspect of the invention, as shown in FIG. 1A, the watery fiber suspension, coming from the inlet slit 3, is first only somewhat drained. With the decreasing radius of the arched surface and a constant tension of the screen belt 2, the draining pressure on the suspension, located between screen belt 2 and the arched surface or the sleeve surface of the roll 1, increases. Thus, high draining capacities can be achieved with already partially drained fiber suspensions. A nozzle 4, which extends over the width of the machine, is directed against the wedge-shaped inlet slit 3. The nozzle 4 supplies the fibrous pulp suspension to the slit 3. As shown in FIG. 1A, the screen belt 2 may be a continuous screen belt.

In accordance with another aspect of the present invention, the sleeve surface of the roll is substantially smooth. However, the sleeve surface has elements that serve to transport the fibrous pulp suspension and the screen belt 2 in the rotation direction of roll 1. The following figures illustrate the transport elements in more detail.

The sleeve surface may also include a rough top surface. It is crucial in the present invention that the arched surface or the sleeve surface of the roll and the roll do not exhibit any openings. Thus, the draining of the fibrous pulp does not occur into the roll interior, as in WO 96/08600. Rather, the draining occurs outside the roll thereby assuring that the screen belt 2 is kept free from contamination due to the constant flow-through.

Figure 1B:
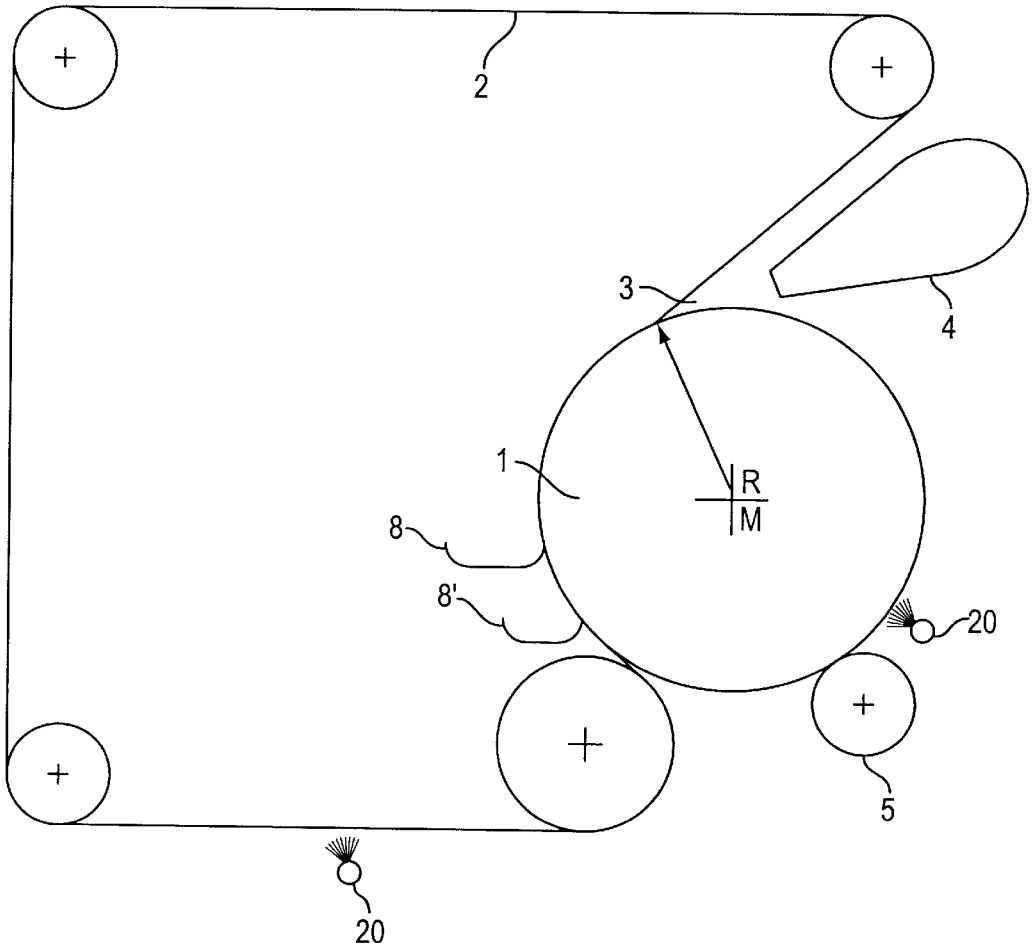
FIG. 1B is a schematic diagram of the device for draining fibrous showing troughs for collecting the drained fluid.

The fluid drained from the fibrous pulp suspension may be collected in one or more troughs or similar collection devices. An exemplary arrangement is illustrated in FIG. 1B in which drained fluid, indicated by arrows 12, pass through screen 2 to be collected in troughs 8 and 8'.

As shown in FIG. 1, any contaminants deposited on the arched surface or sleeve surface of roll 1 can be removed without stopping the machine. For example, the contaminants may be rinsed from the circulating roll or the circulating arched surface with the aid of spray nozzle 20.

The speed of the roll 1 and the screen belt 2 are selected such that a difference exists between the speed of the sleeve surface of the roll 1 and the screen belt 2. Thus, a relative velocity between the sleeve surface of the roll 1 and the screen belt 2 exists.

Thus, each of the elements, i.e., the arched surface (of roll 1) and screen belt 2, is driven at a different speed. However, it is also contemplated that only one of the elements is driven and the other element remains substantially stationary. The differential speed or velocity between the elements may be maintained to be low, e.g., approximately a few centimeters or even a few millimeters per second, and may be maintained to be as high as, e.g., between approximately ten and fifty meters per second. Further, the individual elements may be driven at actual velocities of as low as, e.g., approximately a few millimeters or a few centimeters per second, and as high as, e.g., between approximately ten and fifty meters per second.

In a first example, roll 1 (in FIG. 1) may be driven at a speed of, e.g., approximately 10 m/sec, and screen 2 may be driven at a speed of, e.g., approximately 10.1 m/sec. Thus, a differential velocity or speed of, approximately 0.1 m/sec may be established between the elements in the draining device. In a second example, roll 1 may be driven at a speed of, e.g., approximately 10 m/sec and screen 2 may be driven at a speed of, e.g., approximately 0.1 m/sec. In a third example, roll 1 (in FIG. 1A) may stand still and only screen 2 may be driven at a speed of e.g., approximately 10 m/sec.

As shown in FIG. 1, at the end of the winding zone of the screen belt 2 around the sleeve surface of the roll 1, a substantially dry accumulation of fibers 6 is created which can be in the form of a sheet or, in some cases, may be in the form of small fiber rolls. The drained fibers are removed with suitable conventional known methods as, for example, being transferred to an uptake or removing roll 5 and scraped off with a scraper 7.

Figure 2:
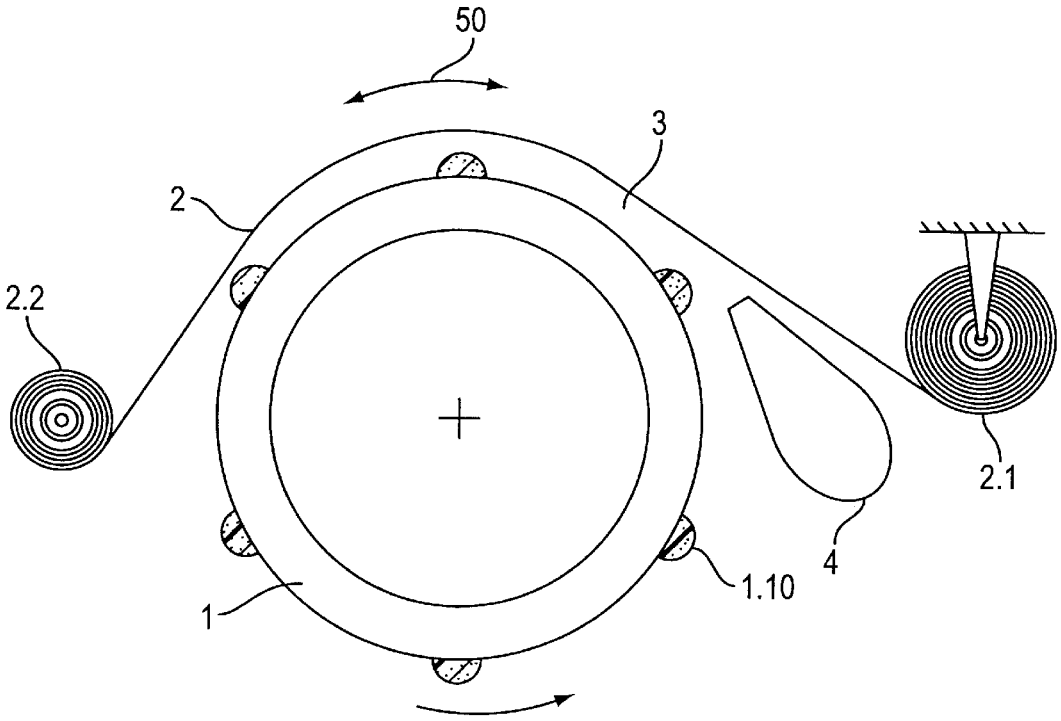
FIG. 2 is a schematic diagram of a second embodiment of the present invention.

In accordance with a second embodiment of the invention, as shown in FIG. 2, the screen belt 2 is not an continuous belt. Rather, the screen belt 2 has two ends. The roll 1 rotates, while the screen belt moves very slowly in the direction of rotation or against the direction of rotation of the roll 1, as indicated by arrow 50 of FIG. 2. The screen belt 2 is thereby unwound from a roll 2.1 and wound onto a roll 2.1. The unwinding and winding processes may occur over an extended period of time.

The roll is shown with rails or cross-pieces 1.10 that are parallel to the axes. These cross-pieces 1.10 may extend over the entire width of the roll 1. However, the cross-pieces 1.10 may also be divided in their longitudinal direction, and the partial cross-pieces may be offset from each other in the rotational direction of the roll 1. The cross-pieces 1.10 serve to transport the fibrous pulp suspension that again is injected in the slit 3 by the pulp head box nozzle 4. The rails or cross-pieces 1.10 can be relatively small in the radial direction of the roll 1. FIG. 2 shows the cross-pieces 1.10 in an exaggerated fashion. The cross-pieces 1.10 may exhibit a radial width of several 1/10 millimeters up to several millimeters. The opposing distance of the rails or cross-pieces 1.10 can measure a few centimeters, or even a few decimeters. It is important that the cross-pieces 1.10 are able to transport the fibrous pulp suspension.

A certain tensile force, which is adjustable, is exerted on the screen belt 2. This adjustable force may also be present and effective in other embodiments of the present invention.

The screen belt 2 is moved at a creeping speed from roll 2.1 to roll 2.2 to prevent potential screen wear by not allowing the cross-pieces 1.10 to make contact at the same locations. Thus, there is uniform wear across the length of the screen belt 2.

Figure 2A:
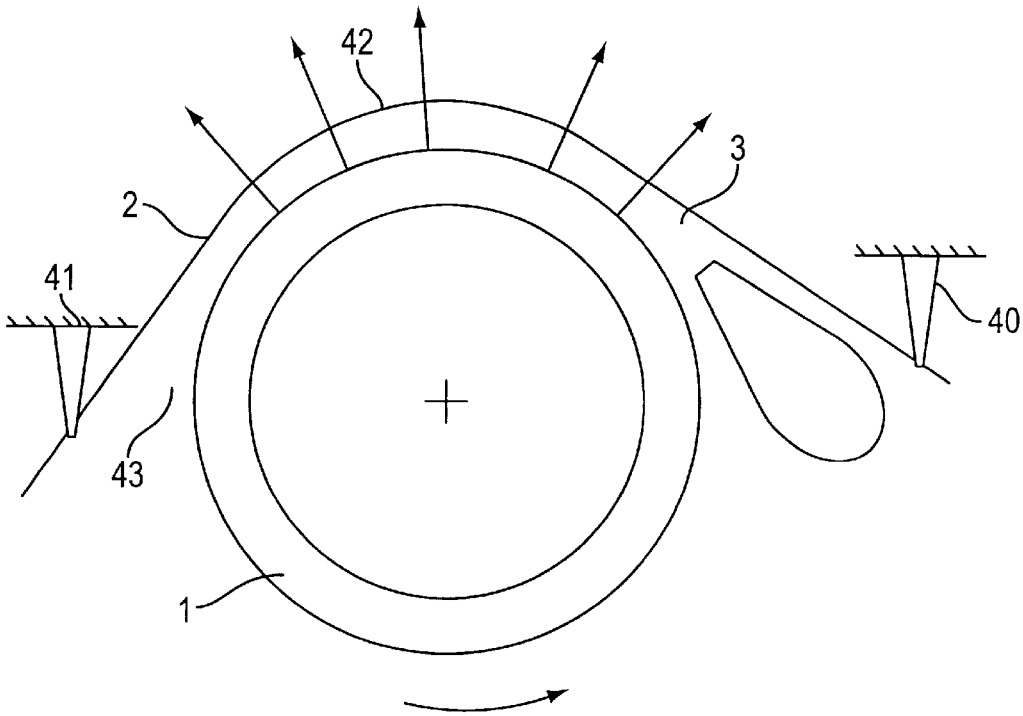
FIG. 2A is a schematic diagram of one aspect of the second embodiment of the present invention.

As shown in FIG. 2A, in accordance with another aspect of the invention, a stiff yet flexible metal sheet 42 is used instead of a relatively flexible or elastic screen belt 2. The metal sheet 42 is clamped in position like the screen belt 2 by its ends 40, 41. Preferably, the metal sheet 42 remains stationary. Because the draining occurs through the metal sheet to the exterior, as shown by the arrows in FIG. 2A, a perforated metal sheet is particularly well suited.

In a particularly preferred embodiment, the metal sheet creates a tapered slit away from the inlet slit 3 in the rotational direction of the roll. This results in a higher draining pressure which improves draining.

Figure 3:
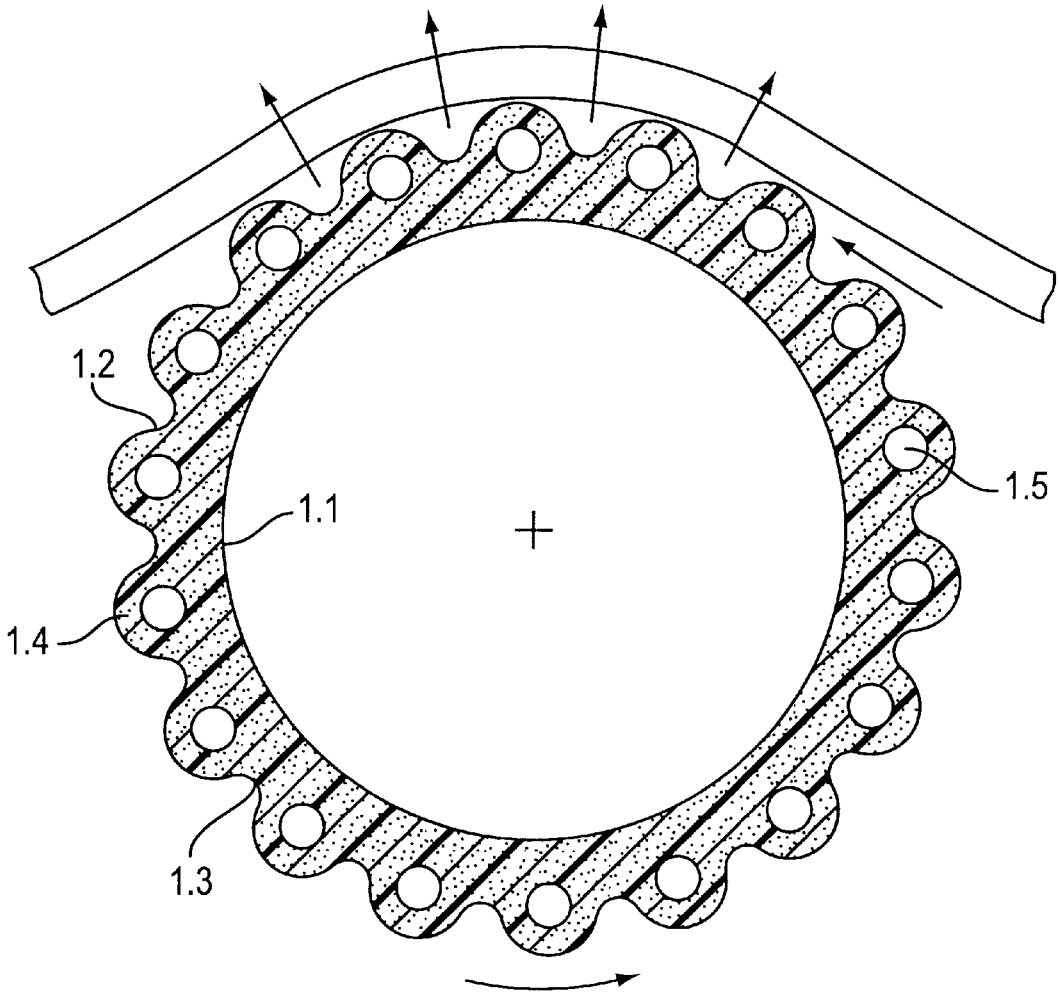
FIG. 3 is a schematic diagram of a third embodiment of the present invention.

FIG. 3 shows yet another embodiment of the present invention. In accordance with one aspect of the invention, the sleeve 1.1 of the roll 1 comprises a material of a certain elasticity and compressibility. The sleeve 1.1 may consist of synthetic material, for example of polyurethane. The arched surface or, in the present example, the sleeve surface 1.2 exhibits recesses 1.3 and bulges 1.4. As shown in FIG. 3, the recesses 1.3 and bulges 1.4 unfold in the form of a wave.

Figure 3C:
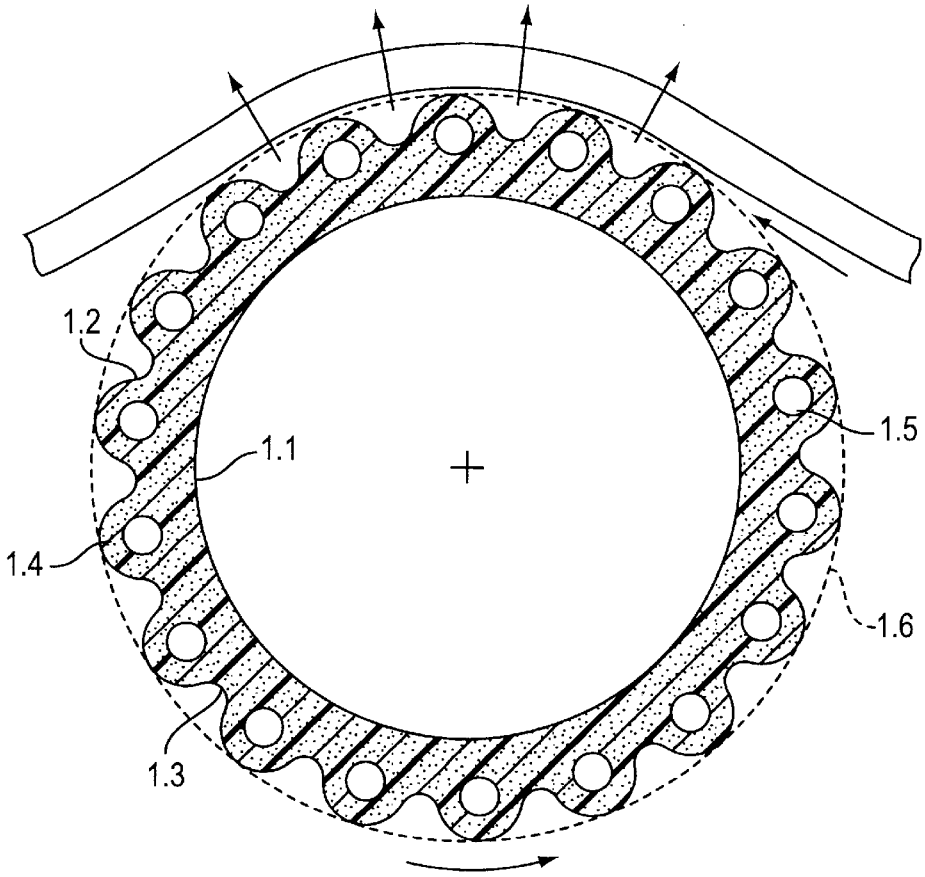
FIG. 3C shows the embodiment of FIG. 3 including a screen covering for the roll.
Figure 3B:
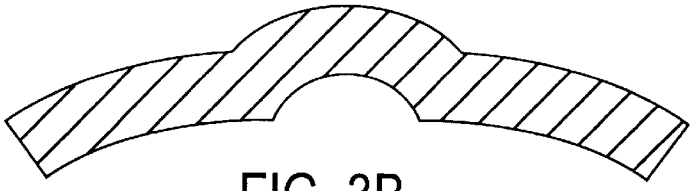
FIG. 3B shows a cross-sectional view of the sleeve showing a raised portion formed in the surface.
Figure 3A:
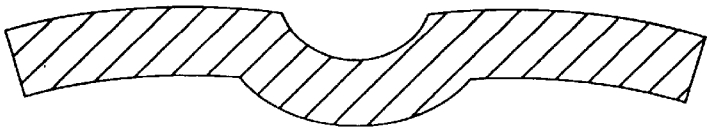
FIG. 3A shows a cross-sectional view of the sleeve showing a depression formed in the surface.

As shown in FIG. 3A, the recesses 1.3 may further be formed by a depression 1.3'. Depression 1.3' may be in the form of, e.g., a spherical dent, and the arched surface may include a plurality of these spherical dents being evenly spaced over the surface of the roll. Alternatively, the depression 1.3' may also be formed, e.g., by grooves extending transverse to the direction of relative movement of the belt and the arched surface. Further, the grooves may be divided into longitudinal sections. As shown in FIG. 3B, the bulges 1.4 may be formed by raised portions 1.4'. The raised portions may be in the form of, e.g., spherical humps, and the arched surface may include a plurality of these spherical humps being evenly spaced over the surface of the roll.

Further, as shown in FIG. 3C, the device may further include a covering screen 1.6 to cover the recesses formed on the arched surface of roll 1.

The sleeve surface 1.2 is enclosed by screen belt 2. The recesses 1.3 represent a transport volume by which the pulp suspension is transported in the rotational direction of the roll. During the transport, a draining of the fibrous pulp suspension occurs radially outwardly through the screen belt 2, as shown by the arrows in FIG. 3 that extend in the radial direction.

Other than as described above, the sleeve surface 1.2 of the sleeve 1.1 is substantially smooth.

In accordance with another aspect of the invention, the recesses 1.3 and bulges 1.4 may be created in different ways. One may, for example, undertake parallel bores 1.5 at even distances to the roll axes. This results in recesses 1.3 being formed during operation.

Another possibility to create recesses is to insert objects into the sleeve material which are spaced across the circumference of the sleeve 1.1. The objects may, for example, consist of rods extending over the entire width of the sleeve 1.1. If these objects exhibit a different compressibility than the remaining sleeve material, a wave form of the sleeve surface 1.2 results.

Another possibility to create recesses is to embed strands made of multi-filaments into the sleeve material such that the strands extend in a direction parallel to the axes. The multi-filaments have a different compressibility than the sleeve material.

Finally, the bores 1.5, or hoses that are inserted into the bores 1.5, may be connected to pressure sources or vacuum sources. Thus, the bores 1.5 may be inflated and deflated. In this manner, the size of the recesses 1.3 can be adjusted during operation of the device.

Figure 4:
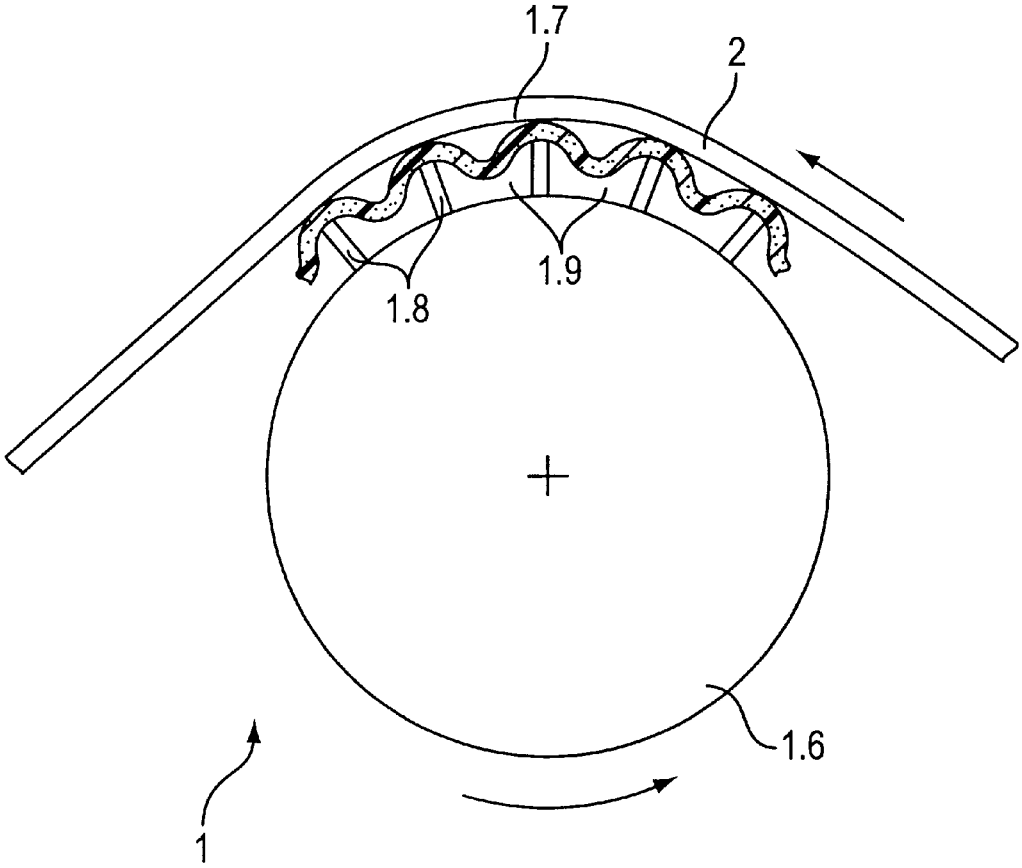
FIG. 4 is a schematic diagram of a fourth embodiment of the present invention.

In accordance with another embodiment of the invention, as shown in FIG. 4, the arched surface, here, the roll 1, includes a support construction. In the present embodiment, the support construction is a cylindrical core 1.6. The cylindrical core 1.6 may either be hollow or solid. Support units or rails 1.8 are located on the sleeve surface of the core 1.6. The support units or rails 1.8 stand radially on the sleeve surface and may be mounted by conventional methods, such as welding.

The support construction or the core 1.6 with the rails 1.8 is surrounded by a hose 1.7. The hose 1.7 consists of an elastic or flexible material. The hose 1.7 exhibits a substantially smooth outer surface and is water impermeable. The hose 1.7 can be shrunk onto the radial rails 1.8 so that a wave profile is achieved during the shrinking process. The gaps 1.9 between adjacent rails 1.8 can, however, also be put under a vacuum or over-pressure, thereby influencing or even changing the wave profile during operation.

Figure 5:
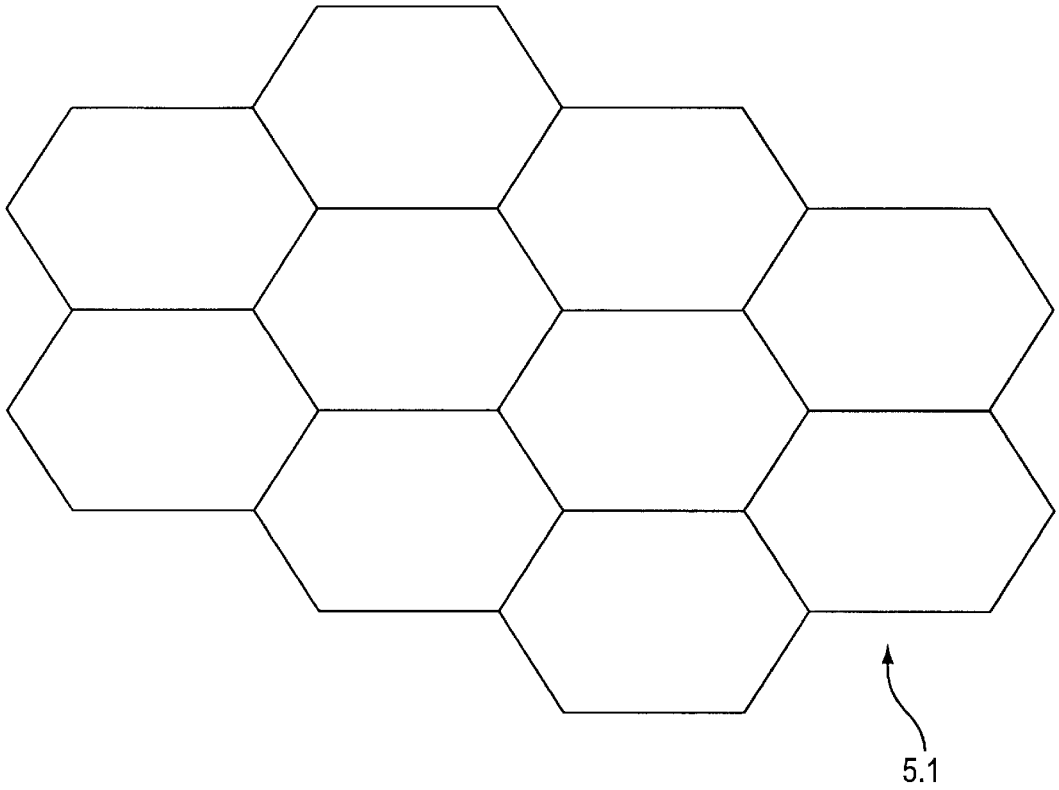
FIG. 5 is a schematic diagram of another aspect of the device for draining a fibrous pulp suspension.

As shown in FIG. 5, in accordance with another aspect of the invention, the roll sleeve 1.1 may be constructed so that along the roll surface any desired shape may be formed or defined, e.g., the surface may include a grid defining a honeycomb pattern 5.1. In this regard, the grid defining honeycomb pattern 5.1 may be formed, e.g., by the above-discuees elements or filaments having a different compression characteristic than the interior portions of the grid. Alternatively, the interior surfaces of the honeycomb pattern 5.1. may be formed, e.g., by recesses. Further, the grid may be formed, e.g., by raised portions or humps in the roll surface, or by objects or bores located within the sleeve. Still further, the grid may be formed by any similar type manner utilized in the prior art.

Figure 6:
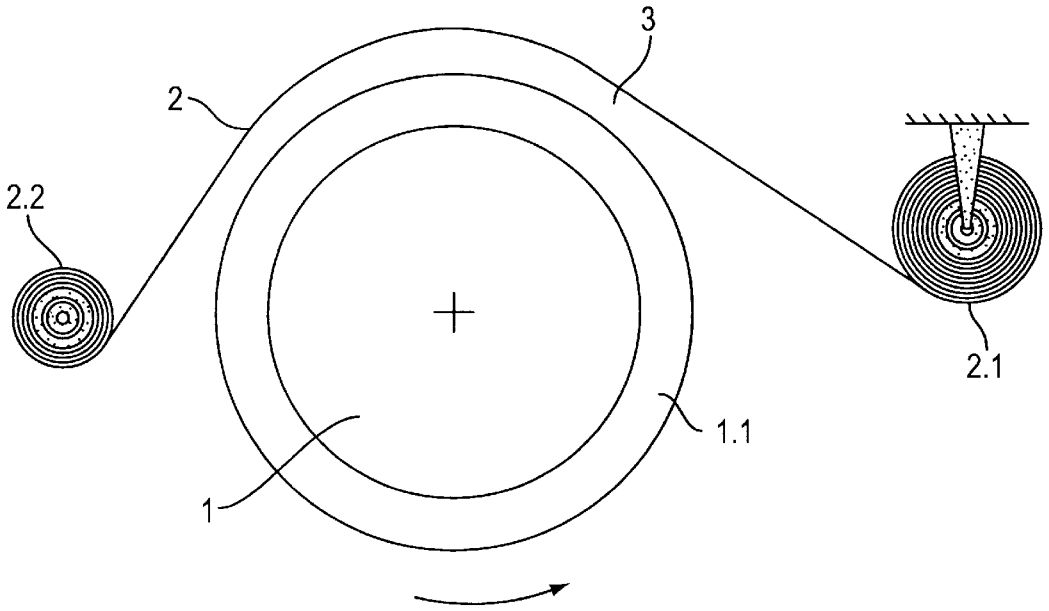
FIG. 6 a schematic diagram of another embodiment of the present invention.

FIG. 6 is a schematic diagram of a side view of another embodiment of the present invention. In FIG. 6, as in FIG. 1 or FIG. 2, the roll sleeve 1.1 comprises a grid. The roll 1 rotates at a relatively high speed. The belt 2 is a finite belt, i.e. it has two ends, one of which may be unwound from one roll 2.1 and the other of which may be wound onto another roll 2.2. While the device is operating, the belt 2 only moves at a creeping speed to prevent wear from occurring at the same location on the belt 2.

Figure 7:
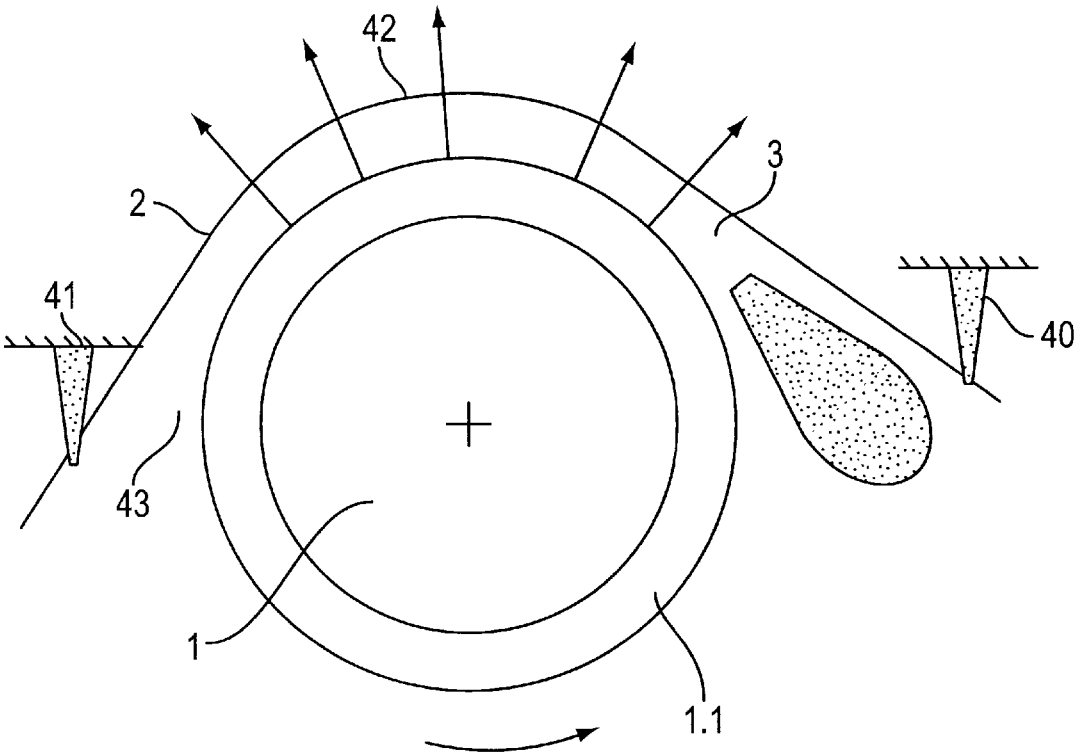
FIG. 7 is a schematic diagram of another embodiment of the device for draining a fibrous pulp suspension.

In accordance with another aspect of the present invention, as shown in FIG. 7, a stiff yet flexible metal sheet 42 is used in place of a flexible or elastic screen belt 2. The metal sheet 42 is clamped in position like the screen belt 2 with ends 40, 41. Preferably, however, the metal sheet 42 remains stationary. Because the draining is to occur through the metal sheet to the exterior, as shown by the arrows extending radially from the roll 1, a perforated metal sheet 42 is particularly well suited.

Preferably, the metal sheet 42 creates a tapered slit away from the inlet slit 3 in the rotational direction of the roll. This results in a higher draining pressure, and therefore, an improved draining.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention.

What is claimed is:

1. A device to drain a fibrous pulp suspension comprising:

an arched surface including a plurality of recesses able to receive a quantity of a fluid wherein said arched surface is impermeable;

a permeable belt wherein said permeable belt encircles said arched surface; and wherein said permeable belt moves relative to said arched surface resulting in a relative velocity between said permeable belt and said arched surface.

2. A device in according to claim 1 wherein said fluid received by said plurality of said recesses comprises fibrous pulp suspension.

3. A device according to claim 1 wherein the device includes a plurality of cross-pieces creating said plurality of said recesses.

4. A device according to claim 1 wherein said device further includes a cleaning device positioned near said arched surface and near said permeable belt and wherein said cleaning device removes contaminants.

5. A device according to claim 1, wherein said arched surface is substantially smooth.

6. A device according to claim 1 wherein said arched surface comprises a roll and said permeable belt comprises two ends and wherein said permeable belt unwinds at a creeping speed from an unwinding roll and winds onto an uptake roll, wherein said unwinding and winding are reversible and wherein said roll is capable of being driven at a high speed relative to said permeable belt.

7. A device according to claim 1 wherein said permeable belt comprises an elastic wire mesh.

8. A device according to claim 1 wherein said permeable belt includes a stiff, flexible surface.

9. A device according to claim 8 wherein said stiff, flexible surface comprises an arched perforated metal sheet placed over said arched surface.

10. A device according to claim 1, wherein said plurality of said recesses are formed by a plurality of spherical dents.

11. A device according to claim 10 wherein said plurality of said spherical dents are spaced evenly across said arched surface.

12. A device according to claim 1 wherein said plurality of said recesses are formed by a plurality of spherical humps.

13. A device according to claim 12 wherein said plurality of said spherical humps are spaced evenly across said arched surface.

14. A device according to claim 1, wherein said recesses comprise a plurality of grooves extending substantially across a direction of said relative movement of said belt and said arched surface.

15. A device according to claim 14, wherein said plurality of said grooves are divided into longitudinal sections.

16. A device according to claim 15, wherein said device includes a plurality of rails creating said plurality of said recesses.

17. A device according to claim 1, wherein the device further includes:

a plurality of bores extending substantially perpendicular to a direction of motion from one face side of said arched surface to the other face side of said arched surface and wherein said arched surface comprises an elastic moldable material.

18. A device in accordance with claim 17, wherein said plurality of said bores are inflatable and deflatable.

19. A device according to claim 1, wherein said device further comprises:

a support construction a hose comprising an elastic material wherein said hose surrounds said support construction; and a plurality of support units positioned between said hose and said support construction.

20. A device according to claim 19, wherein said plurality of said support units form a plurality of gaps between adjacent said plurality of said support units wherein each of said plurality of said adjacent support units can be inflated or deflated.

21. A device according to claim 19 wherein said plurality of said support units comprise rails.

22. A device according to claim 1 wherein said arched surface exhibits a plurality of different radii along a length of said arched surface wherein said plurality of said different radii are measured to a center point of said arched surface.

23. A device according to claim 22, wherein said plurality of said different radii decrease in a direction of said belt rotation wherein a draining pressure is increased with a constant screen tension.

24. A device according to claim 1, wherein the device further includes a covering screen covering said recesses of said arched surface.

25. A device according to claim 24, wherein said covering screen surrounds said arched surface.

26. A device to drain a fibrous pulp suspension comprising:

an arched surface wherein said arched surface is impermeable and includes a plurality of recesses capable of receiving a quantity of fluid and wherein said arched surface includes a grid structure creating said plurality of said recesses;

a permeable belt wherein said permeable belt moves relative to said arched surface resulting in a relative velocity between said permeable belt and said arched surface.

27. A device according to claim 26, wherein each of said plurality of said recesses are able to receive a quantity of the fibrous pulp suspension.

28. A device according to claim 27, wherein said grid structure comprises the shape of a honeycomb.

29. A device according to claim 27, wherein said arched surface comprises a circumference area of a roll.

30. A device according to claim 27, wherein the device further includes a screen covering said plurality of said recesses.

31. A device according to claim 30, wherein said screen surrounds said arched surface.

32. A device to drain a fibrous pulp suspension comprising:

an impermeable arched surface including a grid wherein said grid creates a plurality of recesses capable of receiving a fluid;

a permeable belt wherein said permeable belt moves relative to said arched surface resulting in a relative velocity between said permeable belt and said arched surface.

33. A device according to claim 32 wherein said arched surface and said permeable belt form an inlet slit receiving the fibrous pulp suspension.

34. A device according to claim 32 wherein said arched surface comprises a roll.

35. A device according to claim 34 wherein said roll includes a support construction.

36. A device according to claim 35 wherein said support construction comprises a hollow cylindrical core.

37. A device according to claim 35 wherein said support construction comprises a solid cylindrical core.

38. A device according to claim 35 wherein said support construction further includes:

a cylindrical core;

a plurality of rails forming a plurality of gaps wherein said plurality of said rails extend radially from a surface of said cylindrical core;

a flexible hose wherein said flexible hose is water impermeable and wherein said flexible hose is capable of shrinking onto said plurality of said rails thereby forming a wave profile over which said permeable belt travels.

* * * * *